US005937373A

United States Patent [19]

Ferrar

[11] Patent Number: 5,937,373

[45] Date of Patent: Aug. 10, 1999

[54] METHOD OF CONTROLLING AN UNDERGROUND FLUID FLOW SYSTEM

[75] Inventor: Scott J. Ferrar, Wheeling, Ill.

[73] Assignee: The E.H. Wachs Company, Wheeling, Ill.

[21] Appl. No.: 08/948,008

[22] Filed: Oct. 9, 1997

[51] Int. Cl.[6] ..... F16K 31/12

[52] U.S. Cl. ..... 702/187; 702/113; 702/114; 364/528.17; 364/138; 73/195

[58] Field of Search ..... 702/187, 113, 702/114, 6, 47, 51; 364/138, 528.17; 73/195, 861.02

[56] References Cited

U.S. PATENT DOCUMENTS 4,313,168 1/1982 Stephens et al. ..... 705/413
4,951,224 8/1990 Hokynar ..... 702/47
5,132,904 7/1992 Lamp ..... 364/528.17
5,381,996 1/1995 Arnemann et al. ..... 251/59

*Primary Examiner*—John Barlow
*Assistant Examiner*—Hien Vo
*Attorney, Agent, or Firm*—Robert L. Marsh

[57] ABSTRACT

A method of operating a municipal water system employs a master computer having a memory which retains information regarding all the valves in the system. One assigned to exercise certain valves in the system obtains a print out of current information regarding the valves to be exercised from the computer. A valve turning machine which is controlled by a hand held computer is provided to the operator and after the operation exercises the assigned valves, information stored in the hand held computer is down loaded into the memory of the master computer to thereby update the municipal recorder.

3 Claims, 3 Drawing Sheets

METHOD OF CONTROLLING AN UNDERGROUND FLUID FLOW SYSTEM

The present invention relates to the controlling of a fluid flow system, such as the water system of a city, and in particular to a method for computerizing the control of such a system.

BACKGROUND OF THE INVENTION

The water system for a city consists of water storage tanks, pumping stations, and a network of pipes to distribute the water to residents. A properly constructed network of water distribution pipes will have valves at all critical locations in the network such that portions of the network can be shut down for service without affecting water service to the balance of the city. The pipes which make up the water distribution system range in size from as small as three or four inches in diameter to as large as two feet in diameter, and the valves for controlling the flow of water through the system have similar ranges of sizes. Also, most municipal underground water systems have been developed over a period of over fifty years-and incorporate valves from a number of manufacturers.

A water system may have hundreds or thousands of valves, each of which is unique in that each valve has its own operating characteristics. For example, to move a valve from the fully closed position to the fully open position will involve turning the stem of the valve a finite number of revolutions in either the clockwise or counterclockwise direction. The normal operation of the system may require that the valve remain open, and closed only when repairs are being made in adjacent pipes. On the other hand, if the valve regulates a backup fluid system, the valve may be normally closed during proper operation of the system. Each valve is also designed to withstand a given maximum torque, and the application of excessive torque to a valve will cause damage. The moving parts of the valves in the system are also positioned below the ground level and are subjected to constant humidity, heat, cold, wear, and contaminants such that the working parts gradually deteriorate. A valve that has not been exercised for a substantial period of time will also frequently be "frozen" and an operator must jar the valve stem loose without damaging the valve before it can be exercised. Particles of soot, worn metal, and rust also accumulate on the parts such that the valve stem may bind and lock up before it reaches a fully open or fully closed position.

Valve operating machines are available which have hydraulic motors for rotating an elongate key which extends through a shaft to attach to the valve stem of the valve and open and close the valve. Such hydraulically operated valve controlling machines, however, are capable of applying an excessive amount of torque to a valve stem. The operators of such machines must avoid forcing a valve beyond its maximum number of revolutions or applying excess torque to a valve which has become locked up before it has reached the fully opened or fully closed condition.

U.S. Pat. No. 5,381,996 discloses a hydraulically driven valve operating machine which is controlled by a computer. This machine requires that the operator insert into the computer the parameters of the valve to be operated before initiating the exercise, and the programmed machine will carry out an exercise which does not exceed the parameters of the valve.

It is not uncommon to exercise 10 to 20 valves of a municipal water system during the course of a single day, and it is critical for the proper operation of the system that accurate records of all the valves of the system be maintained. Currently, a municipality assigns a number to each of its valves and retains the information for each valve in a card catalog or computer. The record includes information regarding the last operation of the valve, and a technician who is instructed to exercise a given valve must first obtain a copy of the records pertaining to the valve to be operated. At the valve site, the technician will connect the valve operating machine to the valve stem and input the necessary parameters into the computer after which the valve will be exercised. Thereafter, on his return to the central office, the technician will update the records of all the valves he has exercised so that they will be current for the next operation thereof.

The technician using the machine of U.S. Pat. No. 5,381,996 will consume a significant amount of time in obtaining the records of valves to be operated, inputting the parameters from those records into the computer of the machine, and then updating the records of the municipality after the exercise thereof is completed. It would be desirable to provide a system for controlling an underground fluid flow system without requiring a technician to manually load pertinent information into a valve operating machine and to manually update the records of a municipality after the exercises have been completed.

SUMMARY OF THE INVENTION

Briefly, the present invention is embodied in a method of operating a plurality of underground fluid flow valves where each of the valves has a plurality of operating characteristics. The method includes an electronically controlled power driven valve operating machine controlled by a hand-held computer which has a first memory. The method further includes a master computer with a second memory to retain the permanent records of the valves of the fluid flow system. The hand-held computer is adapted to be connected to either the electronically controlled valve operating machine to control the machine or to the master computer for loading information from one memory to the other. The information pertaining to the operation of each of the plurality of valves in the underground fluid flow system are retained in the second memory of the master computer. In a first embodiment of the invention, the master computer is connected to a printer and the computer is used to print a list of the operating information for the valves to be exercised by the technician. The hand-held computer is connected to the electronically controlled valve operating machine, and the machine is successively connected to the valves to be operated. The printed information from the master computer are used by the operator to set maximum torque limits to be applied by the machine and to guide the technician while the valve is being exercised. New data pertaining to the exercise of each valve is retained in the memory of the hand-held computer after it has been exercised.

The hand-held computer will, therefore, retain a record of the various exercises including a record of the condition of the valves as of the completion of the operating exercises. The hand-held computer thereafter is disconnected from the electronically controlled valve operating machine and connected to the master computer, and the records from the memory of the hand-held computer is transferred to the master computer.

In a second embodiment of the invention, the hand-held computer is first connected to the master computer and the operating information for the valves to be exercised are loaded from the master computer to the hand-held computer. Next, the hand-held computer is disconnected from the master computer and connected to the electronically controlled valve operating machine. The technician will thereafter call up in succession the numbers of the valves to which the machine is attached, and the valve operating machine will carry out the exercise of each of the valves within the parameters of their characteristics as shown by the record for the master computer. Upon completion of the exercise of the valves, the hand-held computer will retain a record of the various exercises including a record of the condition of the valves as of the completion of the operating exercises.

The hand-held computer thereafter is disconnected from the electronically controlled valve operating machine and reconnected to the master computer, and the updated records from the memory of the hand-held computer are transferred to the master computer.

BRIEF DESCRIPTION OF THE DRAWINGS

A better understanding of the invention will be had after a reading of the following detailed description taken in conjunction with the accompanying drawings wherein.

DETAILED DESCRIPTION OF THE PREFERRED EMBODIMENT

Figure 1:
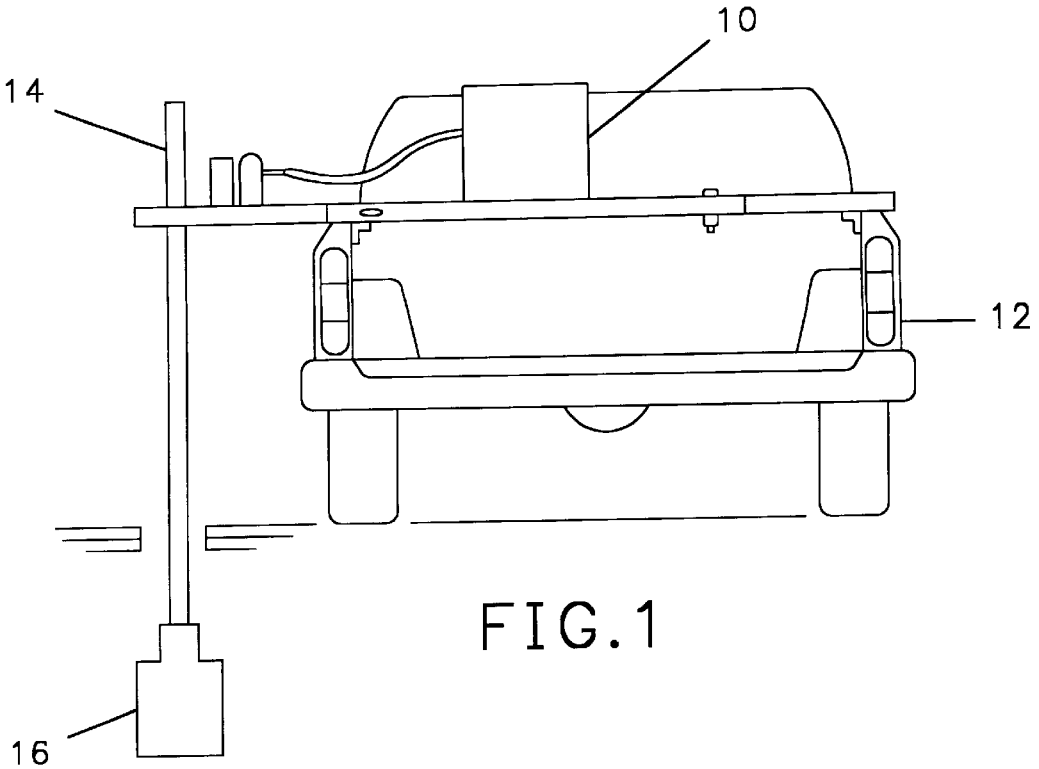
FIG. 1 depicts a valve operating machine positioned to exercise a valve.

Referring to FIG. 1, the apparatus for an underground fluid control system includes a valve operating machine 10 which is typically mounted on a truck 12. The machine 10 has a downwardly extending key 14, the lower end of which can be fitted over the stem of a valve 16. The valve operating machine 10 will rotate the key 14 to exercise the valve 16.

Figure 2:
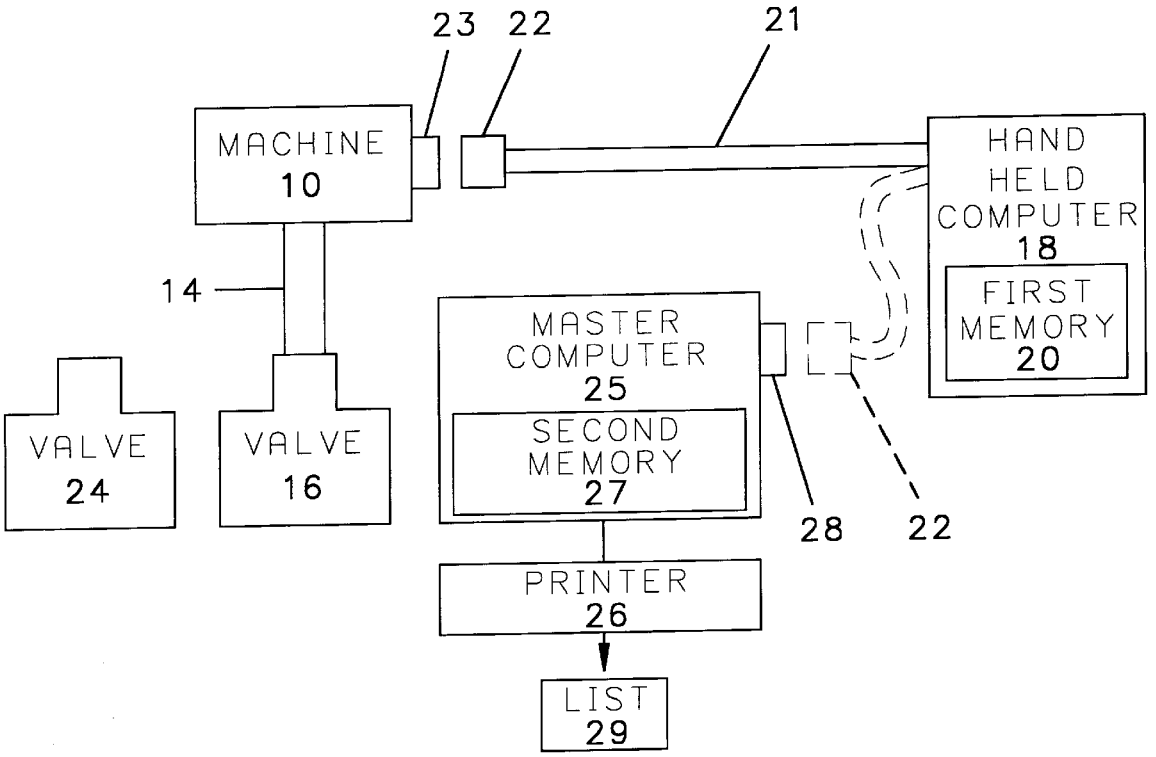
FIG. 2 is a block diagram depicting the components required by the invention to control a fluid flow system.
Figure 3:
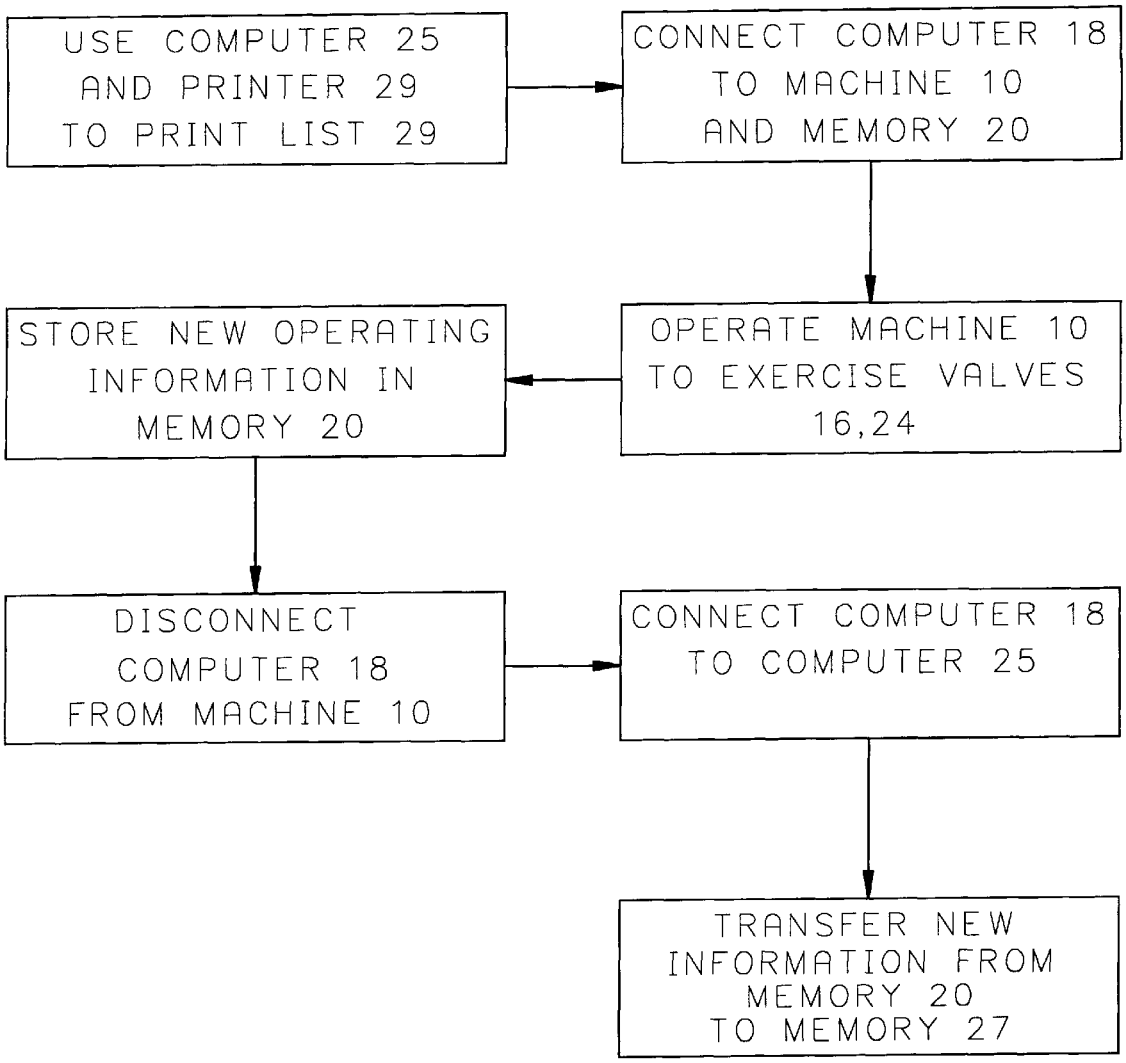
FIG. 3 is a block diagram depicting the steps required to carry out the method of the invention.

Referring to FIGS. 1, 2 and 3, a hand-held computer 18 has a first memory 20, and has a connecting cable 21 with a connector 22 at the end thereof. The connector 22 is adapted to electronically connect to a jack 23 on the valve operating machine 10 such that the computer 18 can direct instruction to the machine 10.

Referring to FIGS. 2 and 3, the method includes a master computer 25 having a printer 26 and second memory 27 for retaining the records of all the valves of the system, including the information pertaining to valves 16 and 24. The master computer 25 has a jack 28 which is similar to the jack 23 of the valve operating machine 10.

To carry out the method, the master computer 25, the second memory 27 and the printer 26 are used to print out a list 29 of the operating information and records of each valve 16, 24 to be exercised by the technician. The information includes the maximum torque which can be applied to the valve, the direction the stem must be rotated to open the valve, the number of turns from the full opened condition to the fully closed condition, the number of turns the valve was turned the last time it was exercised, and the condition of the valve, opened or closed, after the last time it was exercised.

The connector 22 of the hand-held computer 18 is connected to the jack 23 of the valve operating machine 10, and the machine is transferred to the sites of the various valves 16, 24 by the truck 12. The printed list 29 is used by the technician to set torque limits and to assist the technician in the exercise of the valve 16, 24. After exercising each valve 16, 24, the first memory 20 of the hand-held computer will retain updated information pertaining to the valves 16, 24 such as: maximum torque applied; the number of turns rotated; and the direction of rotation during the last exercise.

At the end of the day, the technician will return to the municipal offices, and will disconnect the connector 22 from the jack 23 of the machine 10 and connect it to the jack 28 of master computer 25. The updated records for the valves 16, 24 are transferred from the first memory 20 of the hand-held computer to the second memory 27 of the master computer 25.

Figure 4:
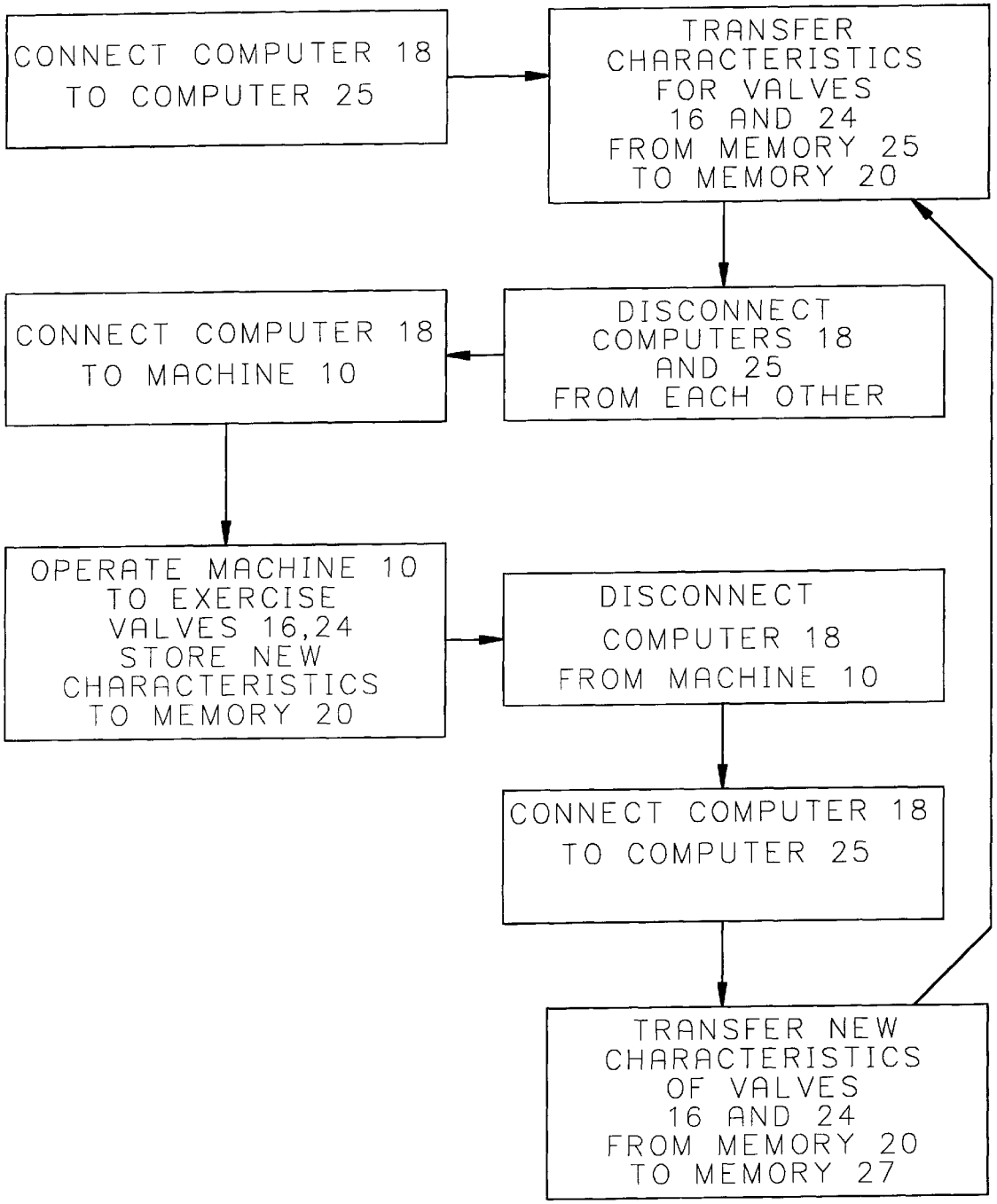
FIG. 4 is a block diagram depicting the steps required to carry out the method of a second embodiment of the invention.

Referring to FIGS. 2 and 4, a second embodiment of the invention employs the same equipment as that employed in the first embodiment, except that a printer is not needed for the second embodiment. The steps of the second embodiment, as depicted in FIG. 4, which are identical to the steps of the first embodiment, bear like indicia numbers. In accordance with this embodiment, the first memory 20 of the hand-held computer 18 is suitable for receiving the operating characteristics for a given plurality of valves 16 and 24. Prior to operating the valves 16, 24, a technician will first connect the hand-held computer 18 to the master computer 25 by attaching the connector 22 to jack 28 of the master computer. Thereafter, the operating characteristics and other information relating to the valves 16, 24, are loaded into the first memory 20 of the hand-held computer from the second memory 27 of the master computer 25. Next, the connector 22 is disconnected from the jack 28 of the master computer and connected to the jack 23 of the valve operating machine 10.

The technician may then transfer the valve operating machine 10 via the truck 12 to the sites of the valve 16, 17 and exercise the respective valves in accordance with the recorded information for each. In the course of exercising the valves 16, 24, the hand-held computer 18 will retain in the first memory 20 updated operating information pertaining to the respective valves 16, 24.

At the end of the day, the technician will return to the municipal offices, and will disconnect the connector 22 from the jack 23 of the machine 10 and connect it to the jack 28 of master computer 25. The updated records for the valves 16, 24 are transferred from the first memory 20 of the hand held computer to-the second memory 27 of the master computer 25. After the records have been transferred to the master computer, the hand-held computer 18 may then receive the operating information for the next valves which are to be exercised by the machine 10 and the cycle is repeated.

While the present invention has been described in connection with a single embodiment, it will be understood by those skilled in the art that many changes and modifications may be made without departing from the true spirit and scope of the invention. It is, therefore, intended by the appended claims to cover all such changes and modifications which come within the true spirit and scope of the present invention.

What is claimed:

1. The method of exercising a plurality of underground fluid flow valves where each of said valves has no electronic components and has current operating information pertaining thereto, said method comprising, providing a power driven valve operating machine, providing a hand-held computer with a first memory, providing a master computer with a printer and a second memory, providing connecting means to detachably connect and disconnect said hand-held computer to said master computer and to said valve operating machine, inserting current operating information for each of said plurality of valves including a first valve and a second valve of said plurality of valves into said second memory of said master computer, printing said current operating information for said first valve and said second valve from said second memory with said master computer and said printer before exercising said first valve and said second valve, connecting said hand-held computer to said valve operating machine, connecting said operating machine to said first valve, exercising said first valve with said valve operating machine, recording in said hand-held computer first memory new operating information for said first valve where said new operating information is derived from the exercising of said first valve, disconnecting said operating machine from said first valve, connecting said operating machine to said second valve, exercising said second valve with said valve operating machine, recording in said hand-held computer first memory new operating information for said second valve where said new operating information is derived from the exercising said second valve, disconnecting said hand-held computer from said valve operating machine, connecting said hand-held computer to said master computer, and loading said new operating information for said first and said second valve into said master computer second memory.

2. The method of operating a first and a second of a plurality of underground fluid flow valves where each of said valves has no electronic components but has a plurality of operating information pertaining thereto, said method comprising, providing an electronically controlled power driven valve operating machine, providing a hand-held computer with a first memory, said hand-held computer for controlling said electronically controlled valve operating machine, providing a master computer with a second memory, providing connecting means for detachably connecting and disconnecting said hand-held computer to said master computer and to said electronically controlled valve operating machine, inserting current operating information for said first and said second of a plurality of valves into said second memory of said computer, connecting said hand-held computer to said master computer, loading said operating characteristics for said first valve and said second valve from said master computer second memory into said hand-held computer first memory, disconnecting said hand-held computer from said master computer, connecting said hand-held computer to said valve operating machine, connecting said operating machine to said first of said plurality of valves, exercising said first of said plurality of valves for which said operating information is stored in said hand-held computer first memory, recording in said hand-held computer first memory new operating information for said first of said plurality of valves where said new operating information is derived from the exercising of said first of a plurality of valves, disconnecting said operating machine from said first of said plurality of valves, connecting said operating machine to a second of said plurality of valves, exercising said second of said plurality of valves for which said operating information is stored in said hand-held computer first memory, recording in said hand-held computer first memory new operating information for said second of said plurality of valves where said new operating information is derived from the exercising of said second of a plurality of valves, disconnecting said hand-held computer from said valve operating machine, connecting said hand-held computer to said master computer, and loading said new operating information for said first and said second of said plurality of valves into said master computer second memory.

3. The method of exercising a plurality of underground fluid flow valves where each of said valves has no electronic components and has given operating information, said method comprising, providing a power driven valve operating machine, providing a hand-held computer with a first memory, providing a master computer with a second memory, providing connecting means to detachably connect and disconnect said hand-held computer to said master computer and to said valve operating machine, inserting said given operating information for said one of said plurality of valves into said second memory of said computer, connecting said hand-held computer to said master computer, loading said operating information for a first and a second of a plurality of valves from said master computer second memory into said hand-held computer first memory, disconnecting said hand-held computer from said master computer, connecting said hand-held computer to said valve operating machine, connecting said operating machine to said a first of said plurality of valves, exercising said first of said plurality of valves with said valve operating machine, recording in said hand-held computer first memory new operating information for said first of said plurality of valves where said new operating information is derived from the exercising of said first of said plurality of valves, disconnecting said valve operating machine from said first of said plurality of valves, connecting said valve operating machine to a second of said plurality of valves exercising said second of said plurality of valves with said valve operating machine, recording in said hand-held computer first memory new operating information for said second of said plurality of valves where said new operating information is derived from the exercising of said second of said plurality of valves, disconnecting said hand-held computer from said valve operating machine, connecting said hand-held computer to said master computer, loading said new operating information for said first and said second of said plurality of valves into said master computer second memory.

* * * * *